US007121453B2

(12) United States Patent
Nass

(10) Patent No.: US 7,121,453 B2
(45) Date of Patent: Oct. 17, 2006

(54) CARTON WITH CORNER POST CONSTRUCTION

(75) Inventor: Jeff Nass, Hardyston, NJ (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 0 days.

(21) Appl. No.: 10/988,798

(22) Filed: Nov. 15, 2004

(65) Prior Publication Data

US 2005/0116017 A1 Jun. 2, 2005

Related U.S. Application Data

(60) Provisional application No. 60/519,918, filed on Nov. 14, 2003.

(51) Int. Cl.
*B65D 5/22* (2006.01)
*B65D 5/66* (2006.01)

(52) U.S. Cl. ..... 229/177; 229/143; 229/191

(58) Field of Classification Search ..... 229/143, 229/177, 191, 918, 167, 168, 179, 919
See application file for complete search history.

(56) References Cited

U.S. PATENT DOCUMENTS 2,276,820 A * 3/1942 Bonfield ..... 229/143
2,711,282 A * 6/1955 Esposito ..... 229/179
3,883,067 A * 5/1975 McGlynn et al. ..... 229/919
4,056,223 A * 11/1977 Williams ..... 229/191
4,082,215 A * 4/1978 Eichenauer ..... 229/143
4,236,740 A * 12/1980 Sorenson et al. ..... 229/143
4,546,913 A * 10/1985 Castillo ..... 229/191
5,289,970 A * 3/1994 McClure ..... 229/143
5,588,585 A * 12/1996 McClure ..... 229/191
5,673,848 A * 10/1997 Garza ..... 229/191
5,996,885 A * 12/1999 Chu ..... 229/191
6,135,347 A * 10/2000 Mueller ..... 229/142
6,651,875 B1 * 11/2003 Chu ..... 229/191
6,675,970 B1 * 1/2004 Nemoto ..... 229/918

FOREIGN PATENT DOCUMENTS

DE 3321614 A1 * 12/1984 ..... 229/918
EP 394544 A1 * 10/1990 ..... 229/191

* cited by examiner

*Primary Examiner*—Gary E. Elkins
(74) *Attorney, Agent, or Firm*—Armstrong Teasdale LLP

(57) ABSTRACT

A carton, fabricated preferably from corrugated paperboard material, including a bottom panel, two side panels, two end panels, a pair of top panels for closing the carton, locking flaps extending from the ends of the top panels and having tabs receivable in the end panels, and further including a plurality of corner support structures, formed from panels emanating from end edges of the end panels.

1 Claim, 2 Drawing Sheets

CARTON WITH CORNER POST CONSTRUCTION

This application claims the benefit of U.S. Provisional Application No. 60/519,918, filed Nov. 14, 2003.

BACKGROUND OF THE DISCLOSURE

1. Field of the Invention

The present invention relates in general to containers and cartons formed at least in part from corrugated paperboard material, and in particular to such containers and cartons that are provided with interior support structures for enhanced stacking strength and/or protection from impact.

2. Background Art

Shipping containers fabricated from corrugated paperboard material are known. Various methods have been provided in the prior art to impart to such containers enhanced stacking strength and protection from impact.

Typically such methods employ the provision of stacking corner support structures and/or buffer structures that are formed from discrete, separate pieces of corrugated paperboard and/or fiberboard and/or polystyrene block or the like, which are attached to the container blanks during formation of the carton, or are inserted into the carton after it has been erected. Such additional components may be less than optimal because of the additional material cost and/or because, being formed from separate components, they can complicate the formation and assembly process.

It would be desirable to provide a carton fabricated from corrugated paperboard material that is provided with enhanced stacking strength, without requiring the provision of separate stacking support structures.

It would be further desirable to provide a carton that is fabricated from corrugated paperboard that is provided with enhanced impact protection for its contents, without the requiring the provision of discrete, separate buffer structures.

It would also be desirable to provide a carton that is fabricated from corrugated paperboard that is easy to set up and capable of being sealed by automatic taping equipment, if desired, while being provided with enhanced stacking strength and impact protection.

These and other desirable characteristics of the present invention will become apparent in view of the present specification, including claims, and drawings.

SUMMARY OF THE INVENTION

The present invention comprises a container for storage and shipment of goods. The container comprises a bottom panel; opposing side panels emanating from side edges of the bottom panel; and end panels emanating from opposing end edges of the bottom panel. Top panels emanate from top edges of the opposing side panels, and are configured to be folded to positions spaced apart from and parallel to the bottom panel.

A locking flap, having a locking tab extending from a free end thereof, emanates from at least one end of each of the top panels. Each locking flap is configured to be folded into an overlying parallel position relative to a corresponding one of the end panels. A slot is formed in each corresponding one of the end panels, for insertingly receiving a respective locking tab, when a respective locking flap is folded over its corresponding end panel.

At least one corner post support structure is operably associated with each end panel, for providing enhanced stacking strength and end shock protection. Each corner post support structure includes a succession of panels, emanating successively from an end edge of each end panel. The succession of panels terminates in a panel disposed in juxtaposed relation to and affixed to, an inside surface of the respective end panel.

DETAILED DESCRIPTION OF THE INVENTION

Figure 1:
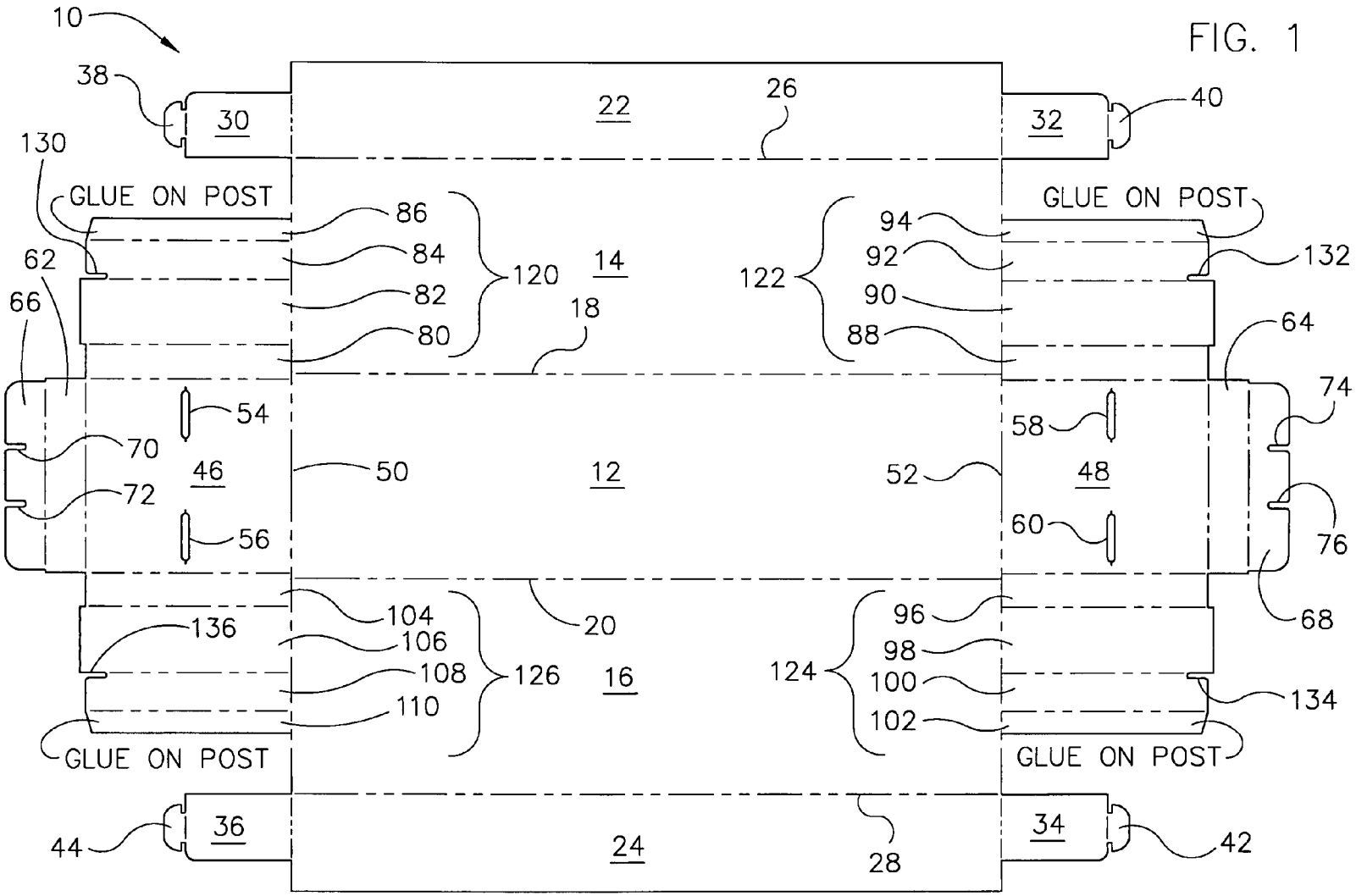
FIG. 1 is a plan view of a blank for forming a carton according to a preferred embodiment of the invention.

While this invention is susceptible of embodiment in many different forms, there is shown in the drawings and will herein be described in detail, a preferred embodiment with the understanding that the present disclosure should be considered as an exemplification of the principles of the invention and is not intended to limit the invention to the embodiment so illustrated.

In the figures, unless otherwise noted, the usual convention for illustration of blanks for cartons fabricated from paper, paperboard, corrugated paperboard and like materials is observed, in that solid lines on the interior of a figure represent cuts, edges or points of inflection (like a ridge, crease or inwardly or outwardly projecting gusset), and broken or dashed lines indicate fold lines, score lines or other lines of weakness.

FIG. 1 illustrates blank 10 for a carton according to a preferred embodiment of the invention. Blank 10 is preferably fabricated from corrugated paperboard material, although in alternative embodiments of the invention, other materials having like performance characteristics may be employed, such as fiberboard or folding carton paperboard material. The direction of the flutes of the corrugated paperboard material is indicated in FIG. 1 by the arrows.

Blank 10 includes bottom panel 12; side panels 14, 16 emanating along fold lines 18, 20 along the side edges of bottom panel 12; top panels 22, 24 emanating along fold lines 26, 28 along the top edges of side panels 14, 16; and locking flaps 30, 32, 34, 36, having locking tabs 38, 40, 42 and 44.

End panels 46, 48, emanate along fold lines 50, 52 from end edges of bottom panel 12. End panels 46, 48 include slots 54, 56; 58, 60, respectively, the use of which is described elsewhere herein. End cover panels 62, 64 emanate along top edges of end panels 46, 48. End closure flaps 66, 68 emanate from inside edges of end cover panels 62, 64. End closure flaps 66, 68 include notches 70, 72; 74, 76, respectively.

Figure 2:
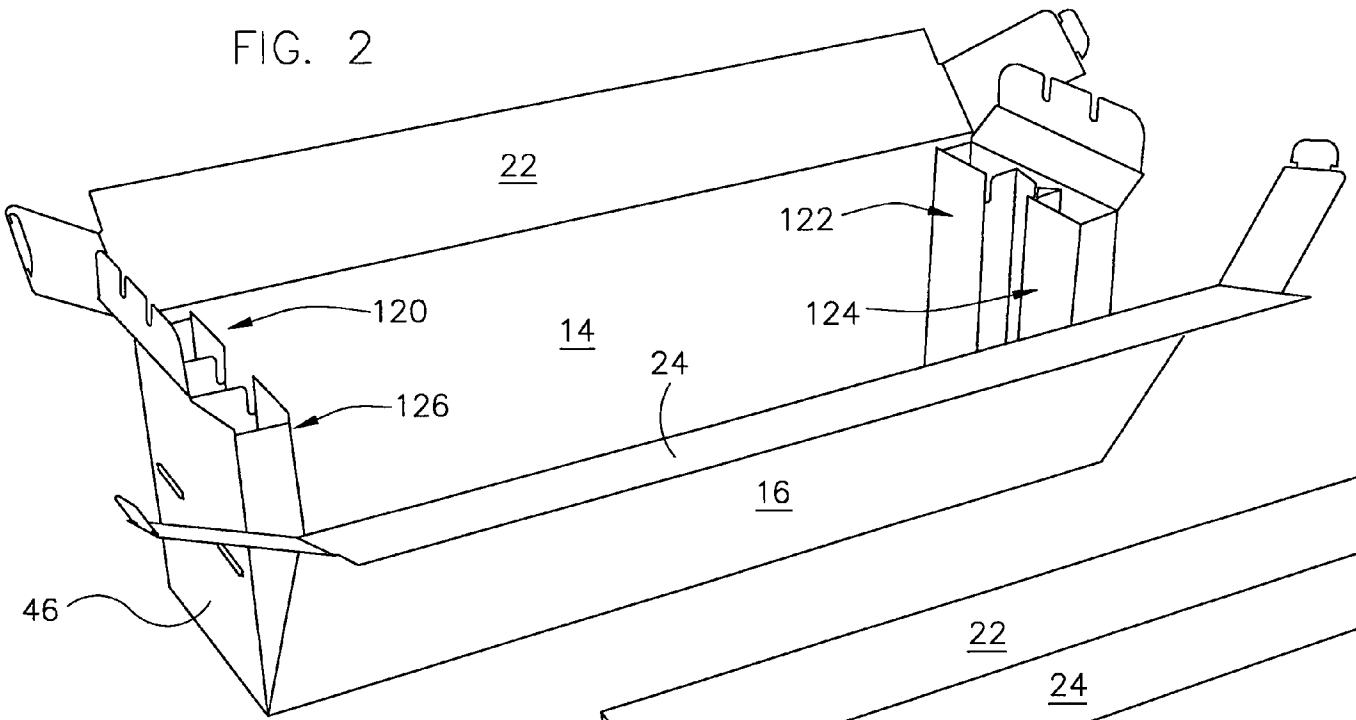
FIG. 2 is a perspective view of a carton, according to the embodiment of FIG. 1, in partially erected configuration.

Blank 10 also includes panels that when folded and glued, form corner support structures 120–126, as shown in FIG. 2. Comer support 120 comprises outer depth panel 80, foldably emanating from end panels 46; transverse panel 82 foldably emanating from outer depth panel 80; inner depth panel 84 foldably emanating from transverse panel 82; and glue panel 84 foldably emanating from inner depth panel 84.

Corner support 122 comprises outer depth panel 88, foldably emanating from end panel 48; transverse panel 90 foldably emanating from outer depth panel 88; inner depth panel 92 foldably emanating from transverse panel 90; and glue panel 94 foldably emanating from inner depth panel 92. Comer support 124 comprises outer depth panel 96, foldably emanating from end panel 48; transverse panel 98 foldably emanating from outer depth panel 96; inner depth panel 100 foldably emanating from transverse panel 98; and glue panel 102 foldably emanating from inner depth panel 100. Corner support 126 comprises outer depth panel 104, foldably emanating from end panel 46; transverse panel 106 foldably emanating from outer depth panel 104; inner depth panel 108 foldably emanating from transverse panel 106; and glue panel 110 foldably emanating from inner depth panel 108.

Corner support structure 120 includes notch 130; corner support structure 122 includes notch 132; corner support structure 124 includes notch 134; and corner support structure 126 includes notch 136.

Figure 3:
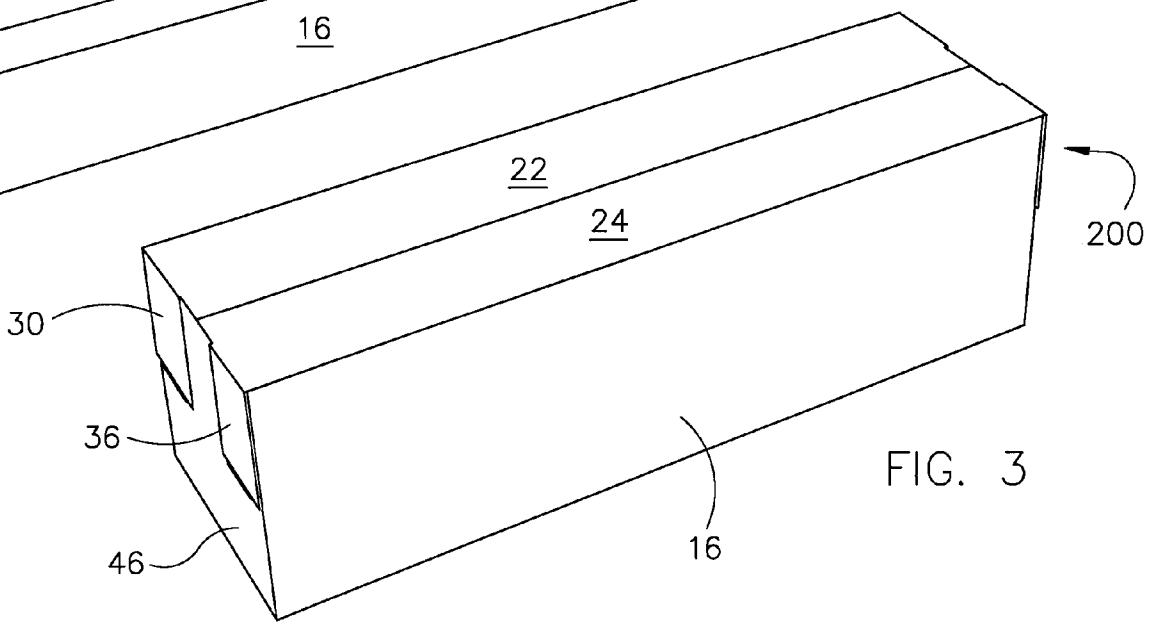
FIG. 3 is perspective view of a carton, according to the embodiment of FIGS. 1 and 2, in fully erected configuration.

Making reference to FIGS. 1–3, blank 10 is first prepared for shipment to a customer/packer by folding and gluing the panels that form corner support structures 120–126. Each of corner supports 120–126 are formed by successively folding the respective panels 86–80; 94–88; 102–96; and 110–104 inwardly at right angles to one another, beginning with the panels furthest from end panels 46, 48, and adhesively affixing panels 86 and 110 to the inside surface of end panel 46, and adhesively affixing panels 94 and 102 to the inside surface of end panel 48. Panel 86 will be glued to panel 46 after being folded on the score between panel 80 and panel 82. Likewise, panel 110 will be glued to panel 46 after being folded on the score between panel 104 and panel 106. Likewise, panel 94 will be glued to panel 48 after being folded on the score between panel 88 and panel 90. Panel 102 will be glued to panel 48 after being folded on the score between panel 96 and panel 98.

Thereafter, the blanks having the corner support structures formed can be transported to the customer who will erect and fill the cartons. Upon arrival at the customer who will be erecting and packing the cartons 200, end panels 46, 48 are folded up perpendicular to bottom panel 12. End cover panels 62, 64 are folded over the tops of corner support structures 120, 126, and 122, 124, respectively, with end closure flaps 66, 68 folded down, so that notches 70, 72, 74, 76 interdigitate with notches 130, 136, 132, 134, respectively.

Side panels 14, 16 are then folded up perpendicular to bottom panel 12. Top panels 22, 24 are then folded up and over to be parallel to bottom panel 12 (as shown in FIG. 3). Flaps 30, 32, 34, 36 are then folded down, over the outside surfaces of end panels 46, 48, with locking tabs 38, 40, 42, 44 being inserted into slots 54, 58, 60, 56, respectively. Thereafter, tape (not shown) may be applied to the top of carton 200, along the adjacent free edges of top panels 22, 24, and down the outer surfaces of end panels 46, 48, if desired.

The carton of the present invention is believed to be advantageous over prior art constructions, in that it provides excellent stacking strength through the corner post constructions, which also provide cells for absorbing endwise impacts. These results are achieved through structural elements that are integral to the carton blank, and are machine formable and erectable, thus providing for reduced cost and simplified formation. Further, upon cutting of the tape (if used), opening of the end closure flaps and end cover panels, carton 200 falls open completely, providing for ease of access in a retail environment, for rapid opening and shelving.

The foregoing description and drawings merely explain and illustrate the invention, and the invention is not so limited as those skilled in the art who have the disclosure before them will be able to make modifications and variations therein without departing from the scope of the invention.

What is claimed is:

1. A container for storage and shipment of goods, comprising:

a bottom panel;

opposing side panels emanating from side edges of the bottom panel;

end panels emanating from opposing end edges of the bottom panel;

top panels emanating from top edges of the opposing side panels, and configured to be folded to positions spaced apart from and parallel to the bottom panel;

a locking flap, having a locking tab extending from an end thereof, emanating from at least one end of each of the top panels, each locking flap being configured to be folded into an overlying parallel position relative to a corresponding one of the end panels;

a slot formed in each corresponding one of the end panels, for insertingly receiving a respective locking tab of the locking tabs, when a respective locking flap of the locking flaps is folded over its corresponding end panel;

an end cover panel having an end closure flap extending from at least one end of each of the end panels, each end closure flap being configured to be folded into a parallel position relative to a corresponding one of the end panels, each end closure flap including at least one flap notch; and at least one corner post support structure, operably associated with each end panel, for providing enhanced stacking strength and end shock protection, each corner post support structure including a succession of panels, emanating successively from an end edge of each end panel, the succession of panels terminating in a panel disposed in juxtaposed relation to and affixed to, an inside surface of the respective end panel, wherein one of the successive corner post support structure panels is positioned parallel to, and spaced apart from, a respective end panel of the end panels, wherein one of the successive corner post support structure panels includes a panel notch that is positioned to insertingly receive the flap notch of a respective end closure flap.

* * * * *